US005823106A

United States Patent [19]

No et al.

[11] Patent Number: 5,823,106

[45] Date of Patent: Oct. 20, 1998

[54] PRINTING APPARATUS FOR CIRCULAR SECTIONAL CONTAINER

[75] Inventors: Shinichiro No; Shinichiro Watanabe, both of Tokyo, Japan

[73] Assignee: Kabushiki Kaisha Yakult Honsha, Tokyo, Japan

[21] Appl. No.: 945,394

[22] PCT Filed: May 8, 1996

[86] PCT No.: PCT/JP96/01214

§ 371 Date: Oct. 27, 1997

§ 102(e) Date: Oct. 27, 1997

[87] PCT Pub. No.: WO96/35580

PCT Pub. Date: Nov. 14, 1996

[30] Foreign Application Priority Data

May 9, 1995 [JP] Japan ..... 7-110803

[51] Int. Cl.[6] ..... B41F 17/00

[52] U.S. Cl. ..... 101/35; 101/38.1; 101/349.1

[58] Field of Search ..... 101/35, 36, 37, 101/38.1, 39, 40, 40.1, 349.1

[56] References Cited

U.S. PATENT DOCUMENTS 435,459 9/1890 Berge ..... 101/39

3,221,643 12/1965 Rudolph et al. ..... 101/38.1

3,486,442 12/1969 Weber ..... 101/40

3,695,176 10/1972 Van Der Roer ..... 101/39

4,195,566 4/1980 Ozawa et al. ..... 101/38 R

*Primary Examiner*—Edgar Burr

*Assistant Examiner*—Daue A. Ghatt

*Attorney, Agent, or Firm*—Beveridge, DeGrandi, Weilacher & Young, L.L.P.

[57] ABSTRACT

A container is carried by a timing screw while a transfer drum is rotated. Ink is transferred by a first imprint roll on a first fixed transfer surface member for printing a shoulder portion of the container and a second fixed transfer surface member for printing a barrel portion of the container. Ink is transferred by a second imprint roll on a movable transfer surface member, and after printing on the shoulder portion, the barrel portion and a constricted portion of the container, which is inserted between a guide member and a transfer roll and moved while rotating, residual inks on the fixed transfer surface member for the shoulder portion, the fixed transfer surface member for the barrel portion, and the movable transfer surface member are removed by a cleaning roll.

1 Claim, 6 Drawing Sheets

PRINTING APPARATUS FOR CIRCULAR SECTIONAL CONTAINER

TECHNICAL FIELD

The present invention relates to a printing apparatus for container having a circular cross section. The printing apparatus comprises transferring ink on a cylindrical container having a constricted portion, particularly a cylindrical container having a shoulder portion, a circular sectional constricted portion having a shorter radius than the radius of the shoulder portion and a barrel portion having the same diameter as the shoulder portion.

BACKGROUND ART

The present applicant discloses in the Japanese Patent Application Publication No. 63-37707 a technique relating to simultaneously print in multiple colors as shown in FIG. 6 on a shoulder portion 4, a constricted portion 5 and a barrel portion 6 of a container 1 having a cap 2, a tapered mouth portion 3, the cylindrical shoulder portion 4, the constricted portion 5 of a circular cross section, and the barrel portion 6 which has the same diameter as the diameter of the shoulder portion.

This well known technique above described is structured so that a transfer surface member for the constricted portion can be protruded from a flat surface of a transfer drum with cams and springs, but the structure is very complicated.

It is an object of the present invention to provide a simultaneous printing apparatus of a simple structure for circular cross sectional containers which simultaneously prints in multiple colors on the container having the constricted portion whose surface is recessed from the surface of the barrel portion.

DISCLOSURE OF THE INVENTION

In a printing apparatus for circular sectional containers of the present invention, the printing is performed by transferring ink on a circular cross sectional cylindrical container having a constricted portion recessed inside along a direction of radius thereof, and the apparatus is provided with imprint rolls for each print portion having a different length of radius of the circular cross sectional container, and the imprint rolls are placed around the transfer drum in decreasing order in length of the radius of each corresponding portion for being printed along the direction of rotation of the transfer drum and the imprint roll for a portion having the longest length of radius of the container is placed at the most upstream in the direction of rotation of the transfer drum. The transfer drum is provided with fixed transfer surface members and movable transfer surface members. The movable transferring surface members are biased along a protruding direction by a resilient means.

For the resilient means, it is preferable to use, for instance, a spring.

In performing the present invention, when the shoulder portion, the barrel portion, and the constricted portion of the container having a circular cross section are different in each radial length, a transfer surface member for a portion of the circular sectional container having the longest radial length is treated as a fixed transfer surface member and other transfer surface members are treated as movable transfer surface members. In such cases, a protruding length for each movable surface member is adjusted by a resilient means, for instance, a spring. And the imprint rolls may be arranged in decreasing order of radius of each corresponding container portion so that ink is first transferred by an imprint roll for a transfer surface member for the container portion having the longest radial length.

It is preferable to form a protruded portion of the movable transfer surface member according to the shape of a corresponding portion of the container to be printed. Or the protruded portion is preferably shaped into a corner cut shape, a chamfered shape, a round corner shape, and a curved shape to prevent friction or interference with other portions on pressing with the imprint roll.

It is also preferable to be composed of an elastic material such as rubber for a surface portion of the fixed transfer surface member and the movable transfer surface member which contact with the container.

In a printing apparatus for a circular cross sectional container being constructed as mentioned above according to the present invention, when an imprint roll which prints an imprint for a portion of the container excepting the constricted portion on the movable transfer surface member engages an already printed movable transfer surface member, the transferred ink on the movable transfer surface member interferes and causes a disadvantage. This disadvantage may be occurred when the apparatus is structured so as to bias the transfer surface member for the constricted portion along a direction of the protrusion only by a spring, though the disadvantage can be avoided when the movable transfer surface member is engaged with the imprint roll at a spot of a predetermined imprint roll using a cam and a spring as described in a patent publication as a well known technique.

However, in the present invention, since the imprint roll for printing a portion having a long radial length is positioned at the upstream side in the rotational direction of the transfer drum, the movable transfer surface member for printing a portion having a short radial length is pressed by the imprint roll but ink is not transferred. Therefore, no disadvantage is produced for the printing.

In a case that a container has a plurality of the constricted portions, the present invention can also be applied in the same way.

The present invention can be applied to a circular cross sectional container having a shoulder portion, a constricted portion, and a barrel portion. When portions having a long radial length are the shoulder portion and the barrel portion, in practice of the printing, the container is carried by a timing screw. While rotating a transfer drum, ink is transferred on the transfer drum for the shoulder portion and the barrel portion through the first imprint roll, and the ink is then transferred only on the movable transfer surface member through the second imprint roll. At this time, the second imprint roll is positioned away from the fixed transfer surface member by a distance of protrusion, so that the second imprint roll transfers ink only on the protruded movable transfer surface member. Then inks on the fixed transfer surface member for the shoulder portion and for the barrel portion are transferred on the shoulder portion and the barrel portion of the container which is inserted between the guide member and the transfer drum and moved in rotating on the axis thereof, and at the same time the ink on the movable transfer surface member is transferred on the constricted portion of the container. Then a remaining inks of the fixed transfer surface members and the movable transfer surface member are removed by means of a cleaning roll.

As described above, in carrying out the present invention, it is also applicable for a container having different radius in length of the shoulder portion, barrel portion and the constricted portion. In such a case, the transfer surface member for a portion having the longest radial length in the circular sectional container is taken as the fixed transfer surface member and other transfer surface members are taken as the movable transfer surface members. The protrusion lengths of the movable transfer surface members are adjusted by a resilient means (for instance, a spring). And the imprint rolls may be arranged in decreasing order in radius of each corresponding container portion so that ink is first transferred by an imprint roll for a transfer surface member to print on the container portion having the longest radial length, then by a corresponding imprint roll for a portion having a second longest radial length and other rolls are in the same manner.

It is preferable for preventing friction or interference with other portion when pressed by an imprint roll to make a protruded portion of the movable transfer surface member into the same shape with a corresponding portion of the container or to remove a sharp corner so as to make a chamfered corner or a round corner.

Incidentally, there is a difference (speed difference) between the fixed transfer surface and the movable transfer surface in a circumferential velocity, caused by a difference between distances from the rotation axis to the fixed transfer surface member and to the movable transfer surface member, in other words, a difference in length in the radial direction. And in a case that the constricted portion of the container has a archery shaped cross section, the movable transfer surface member can intimately contact because of an elasticity of the material thereof. But there is a difference (speed difference) in a circumferential velocity between a top-and-bottom position and a central position of the movable transfer surface member.

These mechanical problems are all resolved by existence of a slip occurred between the container material and the transfer surface member. A distortion of a print image produced by the slip in printing can be ignored from experience when a difference between the longest radial length and the shortest radial length of the container is less than twenty percent. The quality of print has almost no problem when the distortion amount is beforehand considered and corrected in a plate-making design.

BEST MODE FOR CARRYING OUT THE INVENTION

An experiment of the present invention will now be described with reference to the attached drawings.

Figure 1:
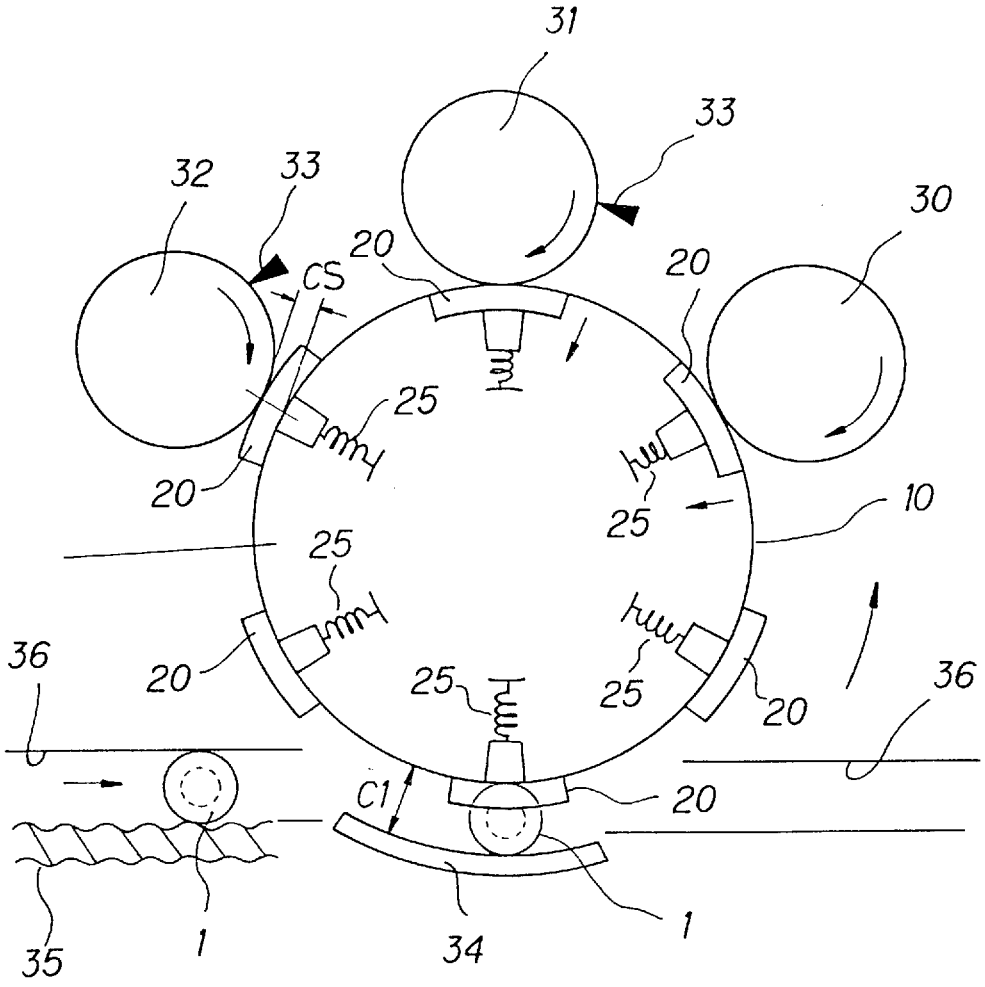
FIG. 1 is a top view of an experiment of the present invention.
Figure 2:
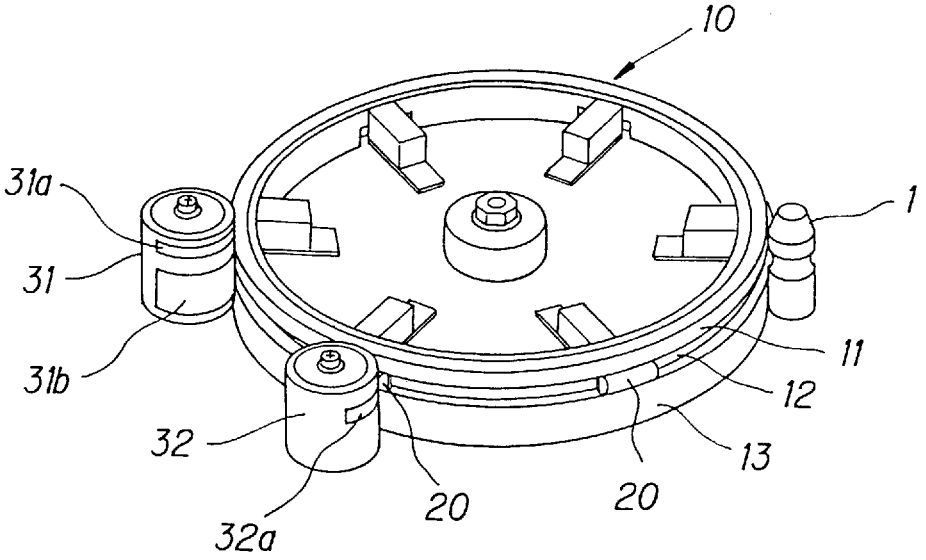
FIG. 2 is a fragmentary perspective view of a main part in FIG. 1.

In FIGS. 1–2, an apparatus of the present invention is comprised of a transfer drum using the designation 10 to show a total Fig., a cleaning roll 30 provided in a slidable manner, a first imprint roll 31 and a second imprint roll 32 arranged around one side of the transfer drum 10 in the above described order from an upstream along a rotational direction shown by an arrow in the Fig., and a guide 34, a timing screw 35, a guide rail 36 arranged around another side of the transfer roll 10.

On the transfer drum 10, a fixed transfer surface member 11 for printing on a shoulder portion 4 of a container 1, a ring-shaped groove 12 which carries a plurality of movable transfer surface members 20 (six members in the drawing), and a fixed transfer surface member 13 for printing on a barrel portion 6 of the container 1 are arranged in the order just described beginning from the upstream along a rotational direction of the transfer drum.

Figure 3:
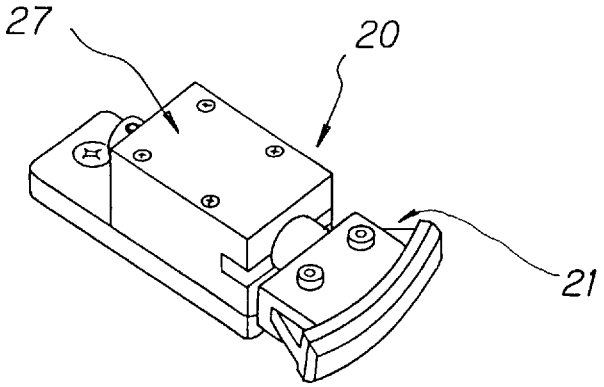
FIG. 3 is a perspective view of a transfer member for a constricted portion.
Figure 4:
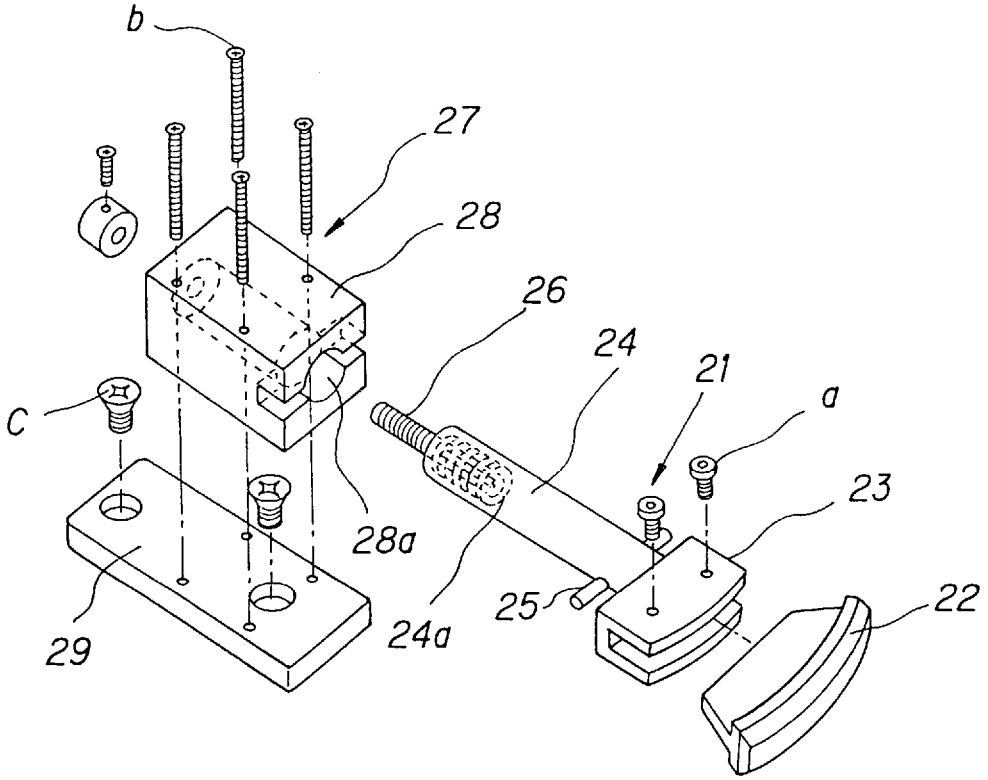
FIG. 4 is an exploded view of FIG. 3.

The movable transfer surface member 20 is mainly defined by a transfer member 21 and a holder 27 as shown in FIGS. 3–4. The transfer member 21 is consisted of an arc-shaped transfer piece 22, a yoke 23 fixing the transfer piece 22 with screws a, an axle member 24 protruding from the yoke 23, and a holding pin 25 thrusting through the axle member 24 and intersecting therewith at right angles. The holder 27 is consisted of a main body 28 holding the axle member 24 in a slidable manner and a base member 29 fixing the main body 28 with screws b. The base member 29 is fixed on the bottom surface of the transfer drum 10 with screws c. A spring 26 is inserted between an inner hole 28*a* and an inner hole 24*a* of the axle member 24 and the transfer member 21 is biased outward along the radius of the transfer drum 10. The transfer member 21 is held along a direction of rotation and the axle by the holding pin 25.

The cleaning roll 30 is based on a well known technique.

The first imprint roll 31 is based on a well known technique and an imprint member 31*a* for the shoulder portion and another imprint member 31*b* for the barrel portion are provided on the peripheral surface thereof.

The second imprint roll 32 is based on a well known technique and has a clearance CS (almost equal to the thickness of the transfer piece 22) with the transfer drum 10 and a movable imprint member 32*a* is provided on the peripheral surface thereof. The imprint roll 31 and 32 are biased toward the transfer drum 10 by not shown springs having a larger force than that of the spring 26. Doctors 33,33 based on a well known technique are arranged in making contact on the peripheries of the imprint rolls 31 and 32.

The guide 34 is formed in an arc shape, coaxial with the transfer drum 10 and a clearance C1 of very small length shorter than the outer diameter of the container 1 is formed between the guide 34 and the transfer drum 10 so that the container 1 is held in the clearance C1 between the guide 34 and the rotating transfer drum 10, and moved in rotating by friction.

The timing screw 35 and the guide rail 36 are based on a well known technique.

The movable transfer surface member 20 can be vertically arranged in plural number, and both the imprint roll 32 and the cleaning roll 30 can be arranged in plural numbers.

A printing process is explained here.

The container 1 is carried by the timing screw 35 and the transfer drum 10 is concurrently rotated in the direction of the arrow. Ink on the imprint member 31*a* for the shoulder portion and the imprint member 31*b* for the barrel portion are transferred to the fixed transfer surface member for the shoulder portion 11 and the fixed transfer surface member for the barrel portion 13 from the first imprint roll 31. At this time the movable transfer surface member 20 is pressed inside the ring-shaped groove 12 of the transfer drum 10 by the pressure of the roll 31 and becomes the same surface level with the surface of the fixed transfer surface member for the shoulder portion 11 and the surface of the fixed transfer surface member for the barrel portion 13.

Ink on the second imprint member 32*a* is next transferred with pressure to the transfer piece 22 protruded from the transfer drum 10 by a spring 25. The ink on the transfer drums 11 and 13 are transferred to the shoulder portion 4 and the barrel portion 6 of the container 1 rotationally moved by the guide 34, and concurrently the ink on the transfer piece 22 is transferred to the constricted portion 5. Finally, residual inks on the fixed transfer surface member for the shoulder portion 11, the fixed transfer surface member for the barrel portion 13 and the movable transfer surface member 20 are removed by the cleaning roll 30.

Figure 5:
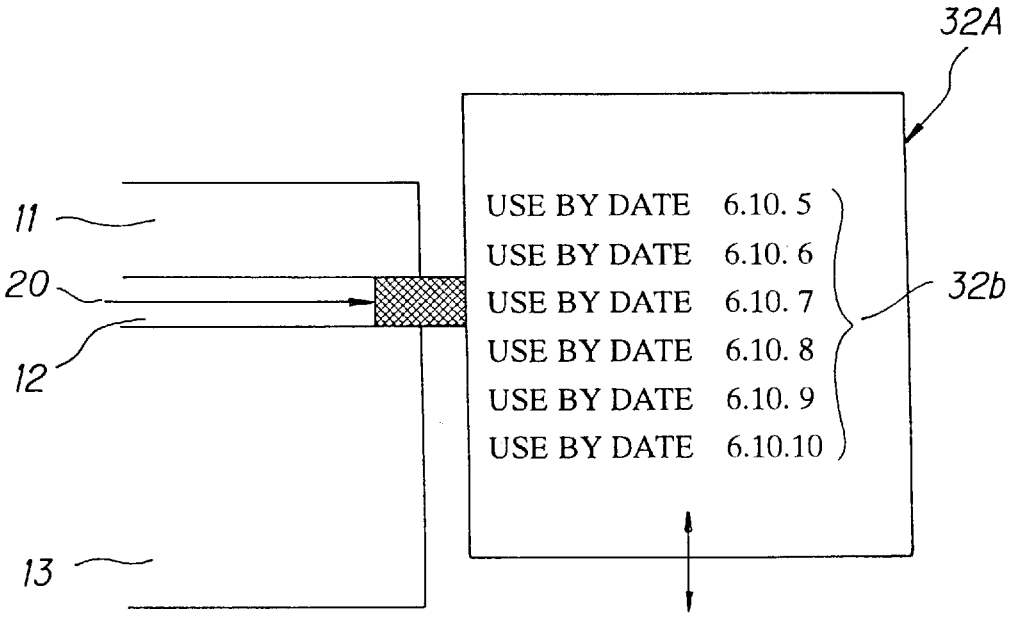
FIG. 5 is a side elevational view of another experiment of a second imprint roll.
Figure 6:
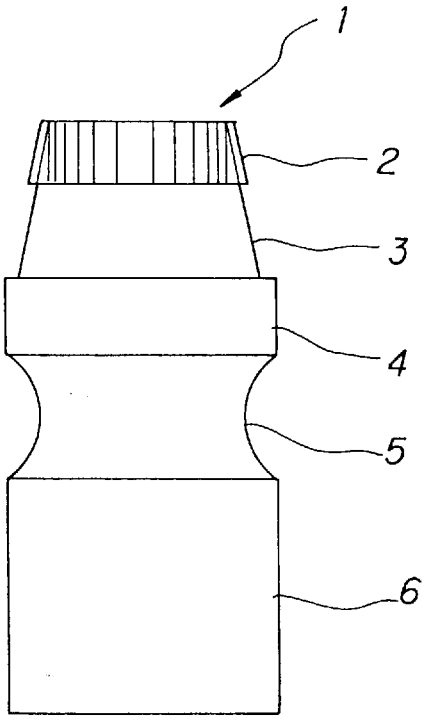
FIG. 6 is a side elevational view of an example of containers related to the present invention.

Another experiment of the second imprint roll is shown in FIG. 5. A movable imprint member 32*b* is formed in a vertically wide manner and a roll 32A is structured in a vertically movable manner. In the experiment, plural date portions are provided on an imprint member 32*a* (6 pieces in the Fig.) and the roll is moved vertically in accordance with a corresponding date and transfers the ink so that the usable period of the roll 32A is extended.

Figure 7:
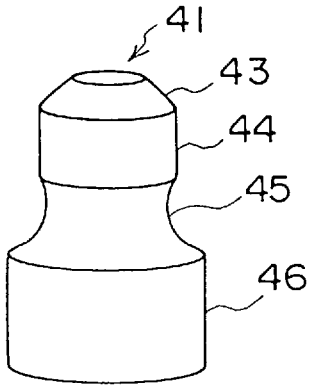
FIG. 7 is a side elevational view of still another example of containers related to the present invention.
Figure 8:
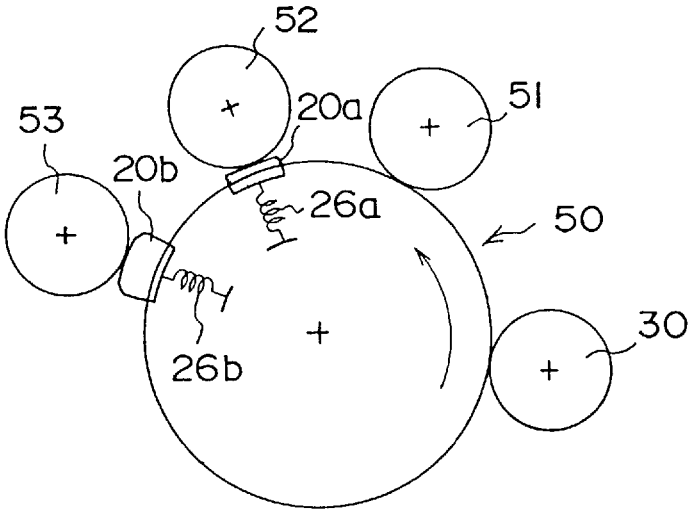
FIG. 8 is a plane view of a main part of another experiment of the present invention.
Figure 9:
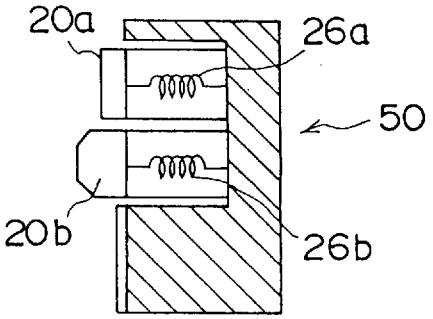
FIG. 9 is a fragmentary enlarged sectional view of FIG. 8.

Still another experiment of the present invention is shown from FIGS. 7–9.

A container 41 having a circular cross section is defined by a mouth portion 43, a shoulder portion 44, a constricted portion 45, a barrel portion 46 as shown in FIG. 7 and the radial lengths of the mouth portion, shoulder portion, barrel portion, and the constricted portion are all different. In order to print on the container 41 having an above described shape, a transfer drum 50 and other members are structured as shown in FIG. 8.

A cleaning roll 30 provided in a rotatable manner, a first imprint roll 51, a second imprint roll 52, and a third imprint roll 53 are arranged around one side of the transfer drum 50 in order from upstream of rotational direction shown with an arrow. A fixed transfer surface member to transfer ink on the barrel portion 46 of the container 41 (similar structure with the fixed transfer surface member 13 for the barrel portion: not clearly shown in the FIGS. 7–9), a movable transfer surface member 20*a* for the constricted portion 45, a movable transfer surface member 20*b* for a shoulder portion 44, a ring-shaped groove to carry the movable transfer surface members 20*a* and 20*b* (not clearly shown in FIGS. 7–9) are arranged on the transfer drum 50.

As for a distinction between the fixed transfer surface member and the movable transfer surface members 20*a*, 20*b*, a transfer surface member to transfer on the barrel portion 46 having the longest radial length in the container 41 having a circular cross section is designated as the fixed transfer surface member and transfer surface members for other portions are designated as the movable transfer surface members. The rolls 30, 51, 52 and 53 are arranged in decreasing order of radius from a transfer surface member corresponding to a portion having longer radial length in the circular cross sectional container 41, more specifically, the roll 51 for the barrel portion 46, the roll 52 for the constricted portion 45, and the roll 53 for the shoulder portion 53 are successively arranged for transferring ink. The protrusion amount of the movable transfer surface member 20*a* and 20*b* are adjusted by springs 26*a*, 26*b* of a resilient means. (FIG. 9).

In FIGS. 8–9, the movable transfer surface members 20*a* and 20*b* are shaped in accordance to corresponding transfer portions (the constricted portion 45 and the shoulder portion 44) of the container 41 and at the same time the whole portion of outer the radius direction of the movable transfer surface member 20*a* is curved and a portion of outer of the radius direction of the movable transfer surface member 20*b* is chamfered. The above described formings eliminate friction and interference of the movable transfer surface members 20*a*, 20*b* with the imprint rolls 51, 52 and 53 when transferring.

Incidentally, the techniques shown from FIGS. 1–9 are only examples and not intended to limit the technical scope of the present invention.

Effect of the Invention

The present invention is structured described above, a container having a constricted portion recessed from a surface of a portion having a long radial length can be concurrently printed in multiple colors with a simple structure using a spring. And even when the lengths in the radial direction of the shoulder portion, the barrel portion, and the constricted portion differ with each other, a printing work or a transfer work for each portion can be suitably performed.

We claim:

1. A printing apparatus for a cylindrical container having at least a first portion and a second portion, said second portion being constricted with respect to said first portion such that said first portion has a larger radial length than said second portion, said printing apparatus comprising:

a transfer drum having a fixed transfer surface member and a movable transfer surface member;

at least first and second imprint rolls associated with said first and second portions of said container, respectively, said second imprint roll being arranged at an upstream point along a rotational direction of said transfer drum and said first imprint roll being arranged upstream from said second imprint roll such that said first and second imprint rolls are arranged according to descending radial length of said first and second portions;

resilient biasing means for biasing said movable transfer surface outwardly.

* * * * *